United States Patent [19]

Huseby et al.

[11] 4,097,291

[45] Jun. 27, 1978

[54] CORE AND MOLD MATERIALS FOR DIRECTIONAL SOLIDIFICATION OF ADVANCED SUPERALLOY MATERIALS

[75] Inventors: Irvin C. Huseby, Schenectady; Frederic J. Klug, Amsterdam, both of N.Y.

[73] Assignee: General Electric Company, Schenectady, N.Y.

[21] Appl. No.: 775,763

[22] Filed: Mar. 9, 1977

[51] Int. Cl.[2] ..... B22C 9/10; B22D 21/00; C04B 35/44; B28B 7/34

[52] U.S. Cl. ..... 106/38.9; 106/62; 106/65; 106/73.2; 106/73.4; 164/41; 164/132

[58] Field of Search ..... 106/73.2, 73.4, 62, 106/65, 38.9; 164/132, 369, 41

[56] References Cited

U.S. PATENT DOCUMENTS

| | | | |
|---|---|---|---|
| 3,514,302 | 5/1970 | Willmore et al. | 106/62 X |
| 3,643,728 | 2/1972 | Hulse | 164/132 |
| 3,725,094 | 4/1973 | Levy et al. | 106/62 |
| 4,031,177 | 6/1977 | Auriol et al. | 106/65 |
| 4,043,377 | 8/1977 | Mazdiyasni et al. | 164/41 |

FOREIGN PATENT DOCUMENTS

| | | | |
|---|---|---|---|
| 618,248 | 2/1949 | United Kingdom | 106/62 |

OTHER PUBLICATIONS

Bailey, J. T. et al. Preparation and Properties of Dense Spinel Ceramics in the $MgAl_2O_4$-$Al_2O_3$ System'-'-Trans. Brit. Cer. Soc., 68 (4) pp. 159-164 (1969).

Fritsche, E.T. et al.-"Liquidus in the Alumina-Rich System $La_2O_3$-$Al_2O_3$"-J. Amer. Cer. Soc., 50 (3) pp. 167-168 (1967).

*Primary Examiner*—Helen M. McCarthy

*Attorney, Agent, or Firm*—Donald M. Winegar; Joseph T. Cohen; Charles T. Watts

[57] ABSTRACT

A ceramic suitable for use in the casting of advanced superalloy materials has a structure including a predetermined porosity content and a material microstructure characterized by a high density of microcracks.

10 Claims, No Drawings

CORE AND MOLD MATERIALS FOR DIRECTIONAL SOLIDIFICATION OF ADVANCED SUPERALLOY MATERIALS

BACKGROUND OF THE INVENTION

1. Field of the Invention

This invention relates to materials suitable for making cores employed in the casting and directional solidification of advanced superalloys such as NiTaC-13.

2. Description of the Prior Art

Superalloys, such as NiTaC-13 and other similar metal eutectic alloys, are cast and directionally solidified at temperatures of about 1700° C and above for upwards of 30 hours exposure thereto. Therefore, cores and molds employed therewith must have high temperature strength and nonreactivity with the molten metal. That is, the mold and core material must not dissolve in the cast molten metal nor form an excessively thick interface compound with the molten metal. The cores also must be compatible with the superalloy to prevent hot tearing during solidification.

It is therefore an object of this invention to provide new and improved core and mold materials for the casting and directional solidification of superalloys.

Another object of this invention is to provide a core having a high degree of crushability to prevent hot tearing of a cast metal during solidification thereof.

Other objects of this invention will, in part, be obvious and will, in part, appear hereinafter.

BRIEF DESCRIPTION OF THE INVENTION

In accordance with the teachings of this invention there is provided a ceramic article useful in the casting and directional solidification of advanced superalloy materials which has enhanced crushability characteristics. The material of the article is a two-phase mixture which is one selected from the group consisting of $La_2O_3 \cdot 11Al_2O_3 + LaAlO_3$, $La_2O_3 \cdot 11Al_2O_3 + Al_2O_3$ and $MgAl_2O_4 + Al_2O_3$. The material is characterized by a microstructure of a plurality of microcracks emanating from approximately the interface of the two-phase material and the single phase material and extending therefrom at least partway through the single phase material. The crushability characteristics are further enhanced by incorporating a predetermined amount of porosity in the structure of the ceramic article. Depending upon the material and the end use of the article the porosity content may range from about 10% by volume to about 70% by volume.

DESCRIPTION OF THE INVENTION

Highly crushable cores suitable for use in casting and directional solidification of superalloy material comprise two-phase mixtures of $La_2O_3 \cdot 11Al_2O_3 + LaAlO_3$, $La_2O_3 \cdot 11Al_2O_3 + Al_2O_3$ and $MgAl_2O_4 + Al_2O_3$. Upon preparing the particular material for a core, it is pressed and sintered to a preferred density within a predetermined range of porosity for the desired end use. Each two-phase material has a coefficient of thermal expansion which is less than that of the superalloy alloy, such as NiTaC-13, which is cast about them. Consequently, upon cooling of the cast melt, the metal is subject to hot tearing.

However, the susceptibility to hot tearing is reduced because during cooling of the two phase material mixture, microcracks may form in the core materials because of the differences in thermal expansion between the materials of the two phases. As a result the core material becomes more crushable. The cooling metal therefore shrinks upon the core and crushes the core thereby reducing the possibility of the occurrence of hot tearing in the metal castings.

The composition of the two-phase mixture $La_2O_3 \cdot 11Al_2O_3 + LaAlO_3$ may range from about 50 mole percent alumina to about 92 mole percent alumina, balance $La_2O_3$. The composition of the two-phase mixture $La_2O_3 \cdot 11Al_2O_3 + Al_2O_3$ may range from about 0.1 mole percent $La_2O_3$ to about 8 mole percent $La_2O_3$, balance $Al_2O_3$. The composition of the two-phase mixture $MgAl_2O_4 + Al_2O_3$ may range from about 60 mole percent $Al_2O_3$ to about 99.9 mole percent $Al_2O_3$, balance MgO.

The materials are prepared in either one of two methods. The first method is to mechanically mix the proper amounts of each of the two oxides of the desired two-phase material mixture, press the material into the desired core configuration and porosity content and sinter the pressed core. The second method is to mechanically mix the proper amounts of each of the two oxides of the desired two-phase material mixture and subject the mixture to calcination. After calcining, the processed material is crushed and ground to a desired particle size. The prepared material is then pressed to the desired core configuration having a given density and sintered. A third method of preparing the material compositions is to mechanically mix the proper amounts of the oxides and then fuse-cast them by heating them close to or above their melting temperature. After fuse casting, the mixture will consist essentially of the desired mixed oxide compound. The fused-cast material is then refined into the desired particle size of from about 10 microns to about 150 microns by suitable milling techniques such as hammer-milling, ball-milling and the like. The desired core configurations are then prepared from this material.

Complicated shapes may be prepared from materials made by any of the above methods by employing a suitable manufacturing technique such as injection molding, transfer molding, and the like.

The crushability of the core comprising one of the two-phase material mixtures may be enhanced by subjecting the core to thermal shock prior to placing it into a mold to be cast. The core is heated to a temperature of about 200° C to about 1000° C and quenched in a suitable agitated liquid, such as water maintained at ~21° C. The thermal shock treatment forms microcracks in the material as a result of the thermal stresses which develop at the interface between the two phases. The size of the cracks is limited by the presence of the two phases, that is the spinel composition surrounded by doped oxide material, which also limit the formation of cracks of sufficient size and length which could lead to catastrophic failure of the article of manufacture made from the ceramic material.

In all instances one must note that the amount of microcracks on the surface in contact with a cast metal must be limited so as to prevent excessive surface imperfections from occurring on the casting. In particular, molten metal must be prevented from entering and solidifying within the cracks so as to make removal of the ceramic material difficult. Additionally, the cost of surface finishing of the casting is increased.

The crushability of the ceramic article of manufacture, such as a core, is further enhanced by introducing a predetermined amount of porosity into the formed ceramic. It has been discovered that the porosity of the ceramic article may be as little as about 10 percent by volume of the article to as great as about 70 percent by volume of the article. It is desired that some of the porosity be continuous throughout so as to enhance the ability of the article to fracture and break up as the cast metal shrinks upon solidifying. A porosity content of about 10 percent by volume is necessary to assure some of the pores being interconnected. However, the degree or amount of porosity is also limited by the need of the article, or core, having a minimum integrity of strength to enable the core to be handled, placed in a mold and to withstand the initial shock and force of the melt being cast into the mold. The core must remain intact during initial solidification and yet be able to be crushed at a later time as the metal shrinks. However, the desired configuration of the cast shape is maintained throughout. In the instance of advanced superalloy materials such as NiTaC-13 directional solidification is practiced for upwards of 30 hours at temperatures in excess of about 1700° C.

Further, the porous structure, in addition to the microcracks, enhances the removal of the ceramic material from the casting after solidification. This occurs in the material's inherent ability now to permit the entry of an etching or leaching solution to reach further into the interior regions of the core. At the same time a greater surface area of the ceramic material is available and exposed to the etching or leaching solutions thereby enabling the ceramic material removal to occur at a faster rate.

Suitable means for removing the ceramic material of two-phase mixtures of $La_2O_3 \cdot 11Al_2O_3 + LaAlO_3$, $La_2O_3 \cdot 11Al_2O_3 + Al_2O_3$ and $MgAl_2O_4 + Al_2O_3$ are molten salts such as molten fluoride salts and/or molten chloride salts. Such suitable salts are $M_3AlF_6$, $M_3AlF_6 + MF$, $M_3Alf_6 + M'F_2$ and $M_3AlF_6 + MCl$ wherein M is Li, Na or K and M' is Mg, Ca, Ba or Sr.

We claim as our invention:

1. A ceramic article useful in the casting and directional solidification of advanced superalloy materials consisting essentially of a two-phase mixture of a material which is one selected from the group consisting of $La_2O_3 \cdot 11Al_2O_3 + LaAlO_3$, $La_2O_3 \cdot 11Al_2O_3 + Al_2O_3$ and $MgAl_2O_4 + Al_2O_3$;

the material is characterized by a microstructure of a plurality of microcracks emanating from approximately a first interface of two different phases and extending at least part way through one phase towards a second interface between two different phases;

the article has a predetermined amount of porosity which is greater than about 10 percent by volume and no greater than about 70 percent by volume, and at least some of the pores are interconnected.

2. The ceramic article of claim 1 wherein the two-phase mixture is $La_2O_3 \cdot 11Al_2O_3 + LaAlO_3$ and the mole percent of $Al_2O_3$ present therein is from about 50 to about 92.

3. The ceramic article of claim 1 wherein the two-phase mixture is $La_2O_3 \cdot 11Al_2O_3 + Al_2O_3$ and the mole percent of $La_2O_3$ present therein is from about 0.1 to about 8.0.

4. The ceramic article of claim 1 wherein the two-phase mixture is $MgAl_2O_4 + Al_2O_3$ and the mole percent of $Al_2O_3$ present therein is from about 60 to about 99.9.

5. The ceramic article of claim 1 wherein the porosity content is from about 30 percent by volume to about 70 percent by volume.

6. The ceramic article of claim 5 wherein the two-phase mixture is $La_2O_3 \cdot 11Al_2O_3 + LaAlO_3$ and the mole percent of $Al_2O_3$ present therein is from about 50 to about 92.

7. The ceramic article of claim 5 wherein the two-phase mixture is $La_2O_3 \cdot 11Al_2O_3 + Al_2O_3$ and the mole percent of $La_2O_3$ present therein is from about 0.1 to about 8.0.

8. The ceramic article of claim 5 wherein the two-phase mixture is $MgAl_2O_4 + Al_2O_3$ and the mole percent of $Al_2O_3$ present therein is from about 60 to about 99.9.

9. The ceramic article of claim 1 wherein at least one microcrack extends across the one phase to intersect the second interface.

10. The ceramic article of claim 9 wherein the at least one microcrack changes direction and extends along a portion of the second interface.

* * * * *